United States Patent [19]

Campbell et al.

[11] Patent Number: 4,819,448

[45] Date of Patent: Apr. 11, 1989

[54] EVAPORATIVE COOLER

[75] Inventors: Charles M. Campell, Tempe, Ariz.; Charles J. Bardo, Fort Worth, Tex.

[73] Assignee: Tradewinds Technologies, Inc., Phoenix, Ariz.

[21] Appl. No.: 95,552

[22] Filed: Sep. 11, 1987

[51] Int. Cl.[4] ..... F28D 5/00

[52] U.S. Cl. ..... 62/304; 62/259.1; 248/237

[58] Field of Search ..... 62/259.1, DIG. 16, 304; 248/237; 182/45

[56] References Cited

U.S. PATENT DOCUMENTS 4,470,271 9/1984 Draper et al. ..... 62/259.1

*Primary Examiner*—Henry A. Bennet

[57] ABSTRACT

An evaporative cooler having a molded plastic base and a molded plastic top cap includes molded plastic legs on the base and molded recesses in the top cap for permitting a plurality of coolers to be stacked. Adjustable leg extensions can be attached to the legs for mounting the cooler on a sloping roof. Latches are pivotally mounted on the corners of the base and the top cap for holding the side panels of the cooler together.

18 Claims, 4 Drawing Sheets

FIG. 6
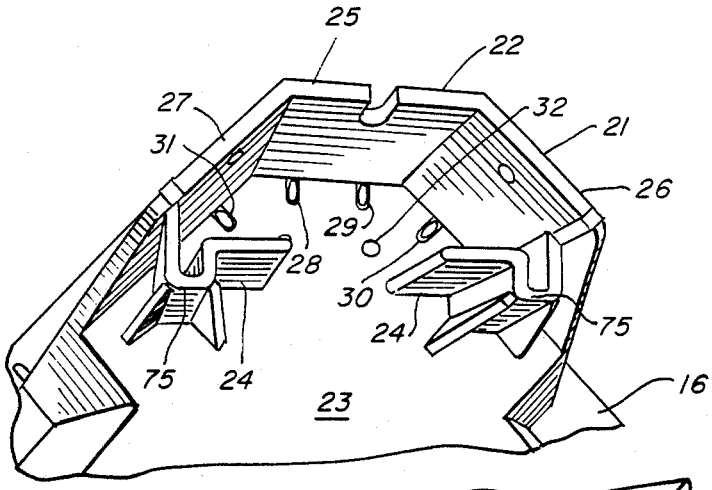
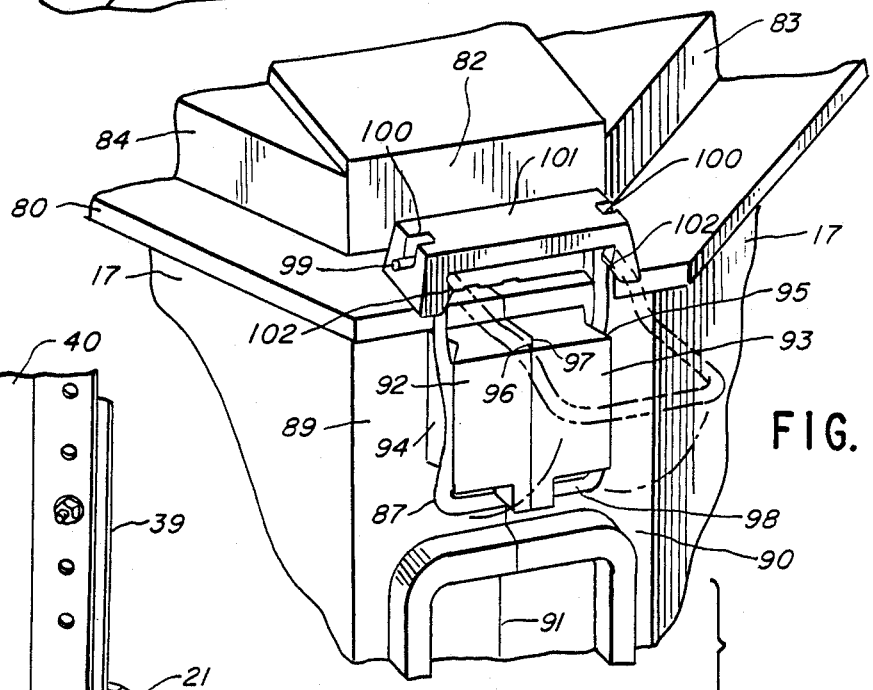
FIG. 8
FIG. 7
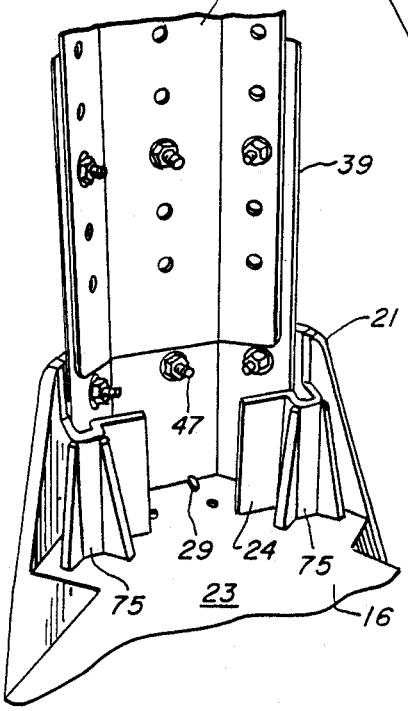
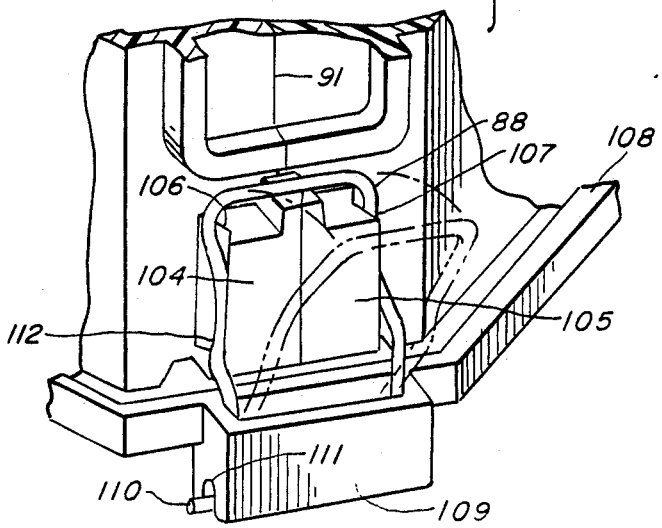

EVAPORATIVE COOLER

This invention relates to evaporative coolers, and, more particularly, to an evaporative cooler which includes a plurality of novel features for facilitating the manufacture, storage and shipping, and use of the cooler.

BACKGROUND AND SUMMARY

This invention is an improvement over the evaporative cooler described in U.S. Pat. No. 4,479,366. The cooler described in that patent includes a molded plastic base, a molded plastic top cap, and four molded plastic side panels which are provided with louvers. The blower and other functional components of the cooler are mounted on the base inside of the side panels, and the top cap is mounted on the blower housing with or without using corner support rods. The louver panels interfit with the base and the top cap and are releasably attached to the top cap by rotating latches.

In accordance with the invention the base is provided with a downwardly extending molded leg at each corner, and the top cap is provided with a molded recess at each corner. A plurality of coolers can be stacked by inserting the legs of the upper cooler into the recesses of the lower cooler. Adjustable leg extensions can be attached to the legs for mounting the cooler on a sloping roof. Latches are pivotally mounted on the corners of the base and the top cap for holding the side panels of the cooler together. Each latch is engageable with a molded latch bracket on each pair of adjacent side panels.

DESCRIPTION OF THE DRAWING

The invention will be explained in conjunction with an illustrative embodiment shown in the accompanying drawing, in which—

FIG. 6 is a bottom perspective view of one of the molded legs of the base of the cooler;

FIG. 7 is a bottom perspective view showing an adjustable leg extension attached to the molded leg;

FIG. 8 is a fragmentary perspective view of the top and bottom latches for latching the side panels;

DESCRIPTION OF SPECIFIC EMBODIMENT

Figure 1:
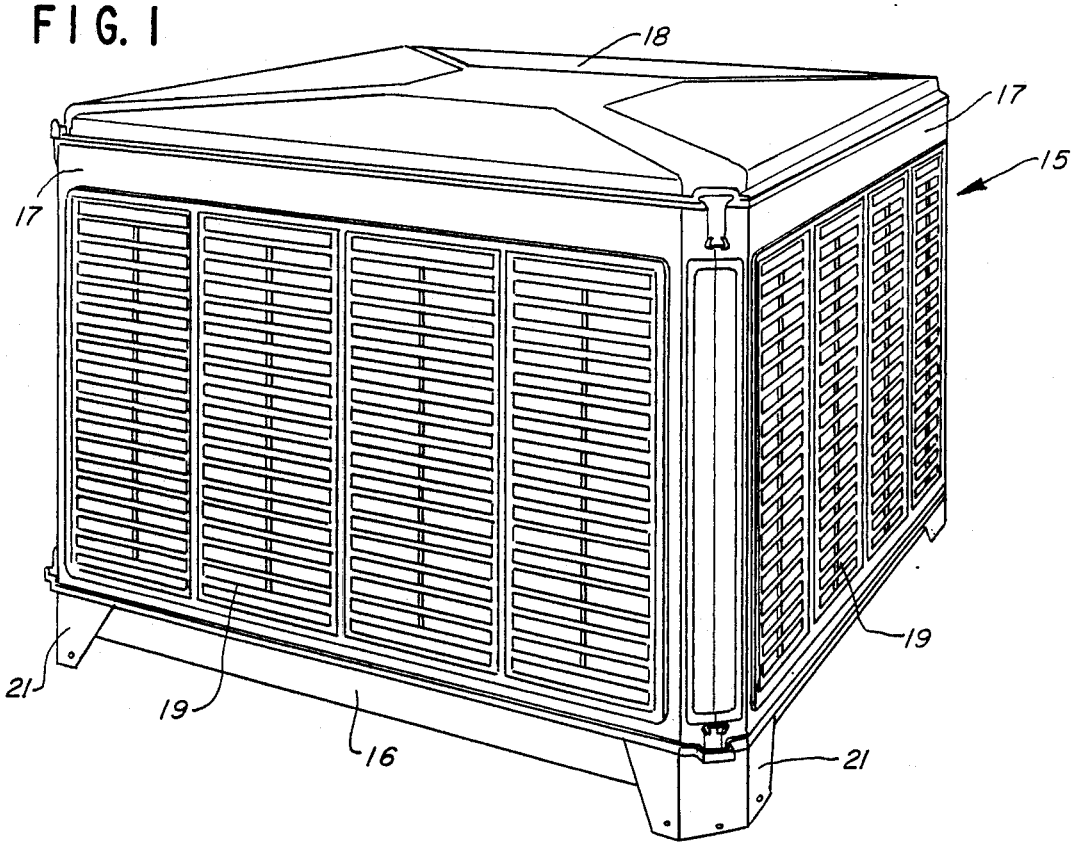
FIG. 1 is a perspective view of an evaporative cooler formed in accordance with the invention.

Referring to FIG. 1, the numeral 15 designates an evaporative cooler which is similar to the evaporative cooler described in U.S. Pat. No. 4,479,366. The cooler includes a molded plastic base 16, four molded plastic side panels 17 which are supported by the base, and a molded plastic top cap 18 which is mounted above the side panels. The interior of the evaporative cooler can be the same as that described in U.S. Pat. No. 4,479,366. The top cap 18 can be mounted on the blower housing as described in the patent with or without vertical corner posts so that the four side panels can be removed without removing the top cap. Each of the side panels includes a louver panel 19.

Figure 3:
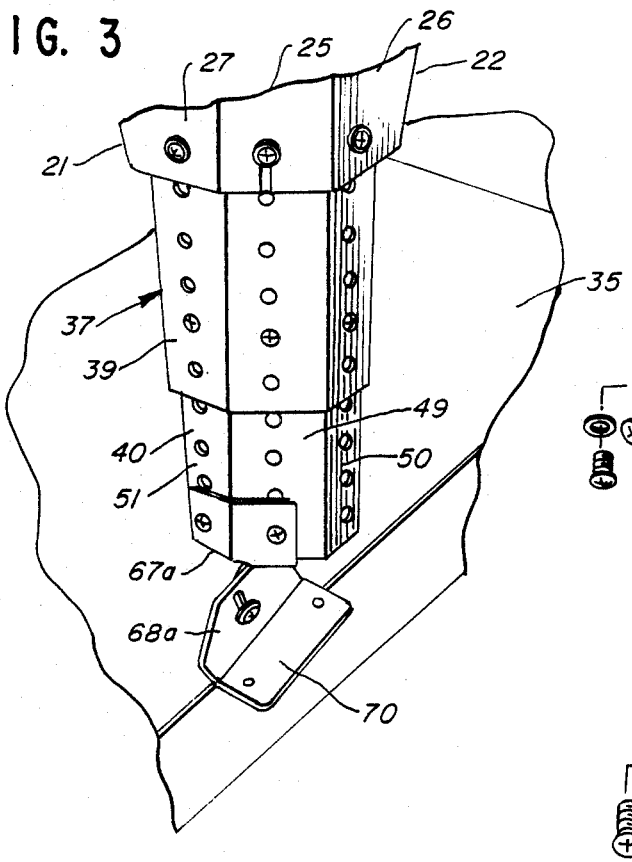
FIG. 3 is a fragmentary perspective view of one of the adjustable leg extensions.
Figure 4:
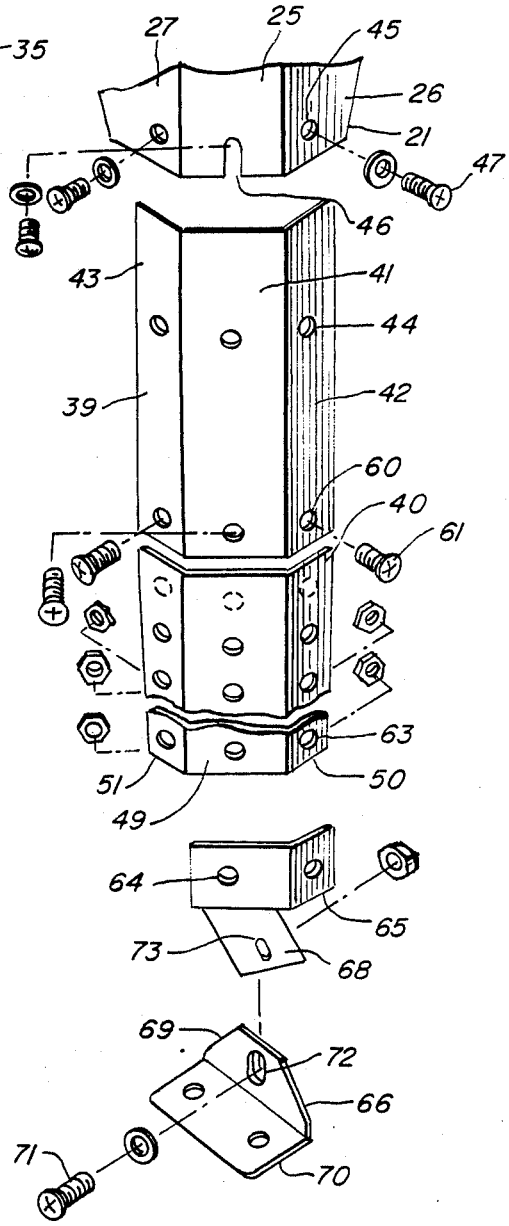
FIG. 4 is an exploded perspective view of one of the adjustable leg extensions.
Figure 5:
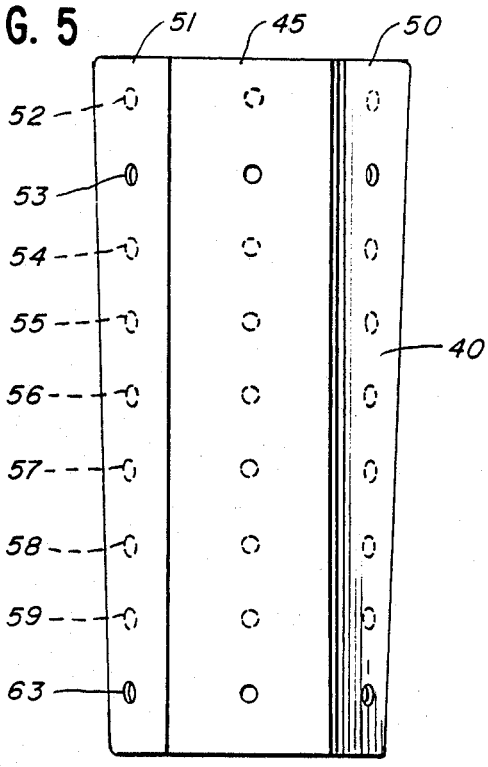
FIG. 5 is an elevational view of the lower part of the leg extension.

The base 16 is generally rectangular, and a downwardly extending leg 21 is molded integrally with the base at each corner. Referring to FIGS. 3, 4, and 6, each leg includes an outer wall 22 which extends vertically downwardly from the bottom surface 23 of the base and a pair of reinforcing inner walls 24. The outer wall includes a central panel 25 and a pair of diverging side panels 26 and 27, each of which form an obtuse included angle with the central panel. A pair of molded detents or projections 28 and 29 (FIG. 6) extend downwardly from the base adjacent the central leg panel 25, and molded detents 30 and 31 extend downwardly adjacent side panels 26 and 27, respectively. The base is provided with a pair of molded-in holes 32 for attaching the base to a conventional roof stand if desired.

Figure 2:
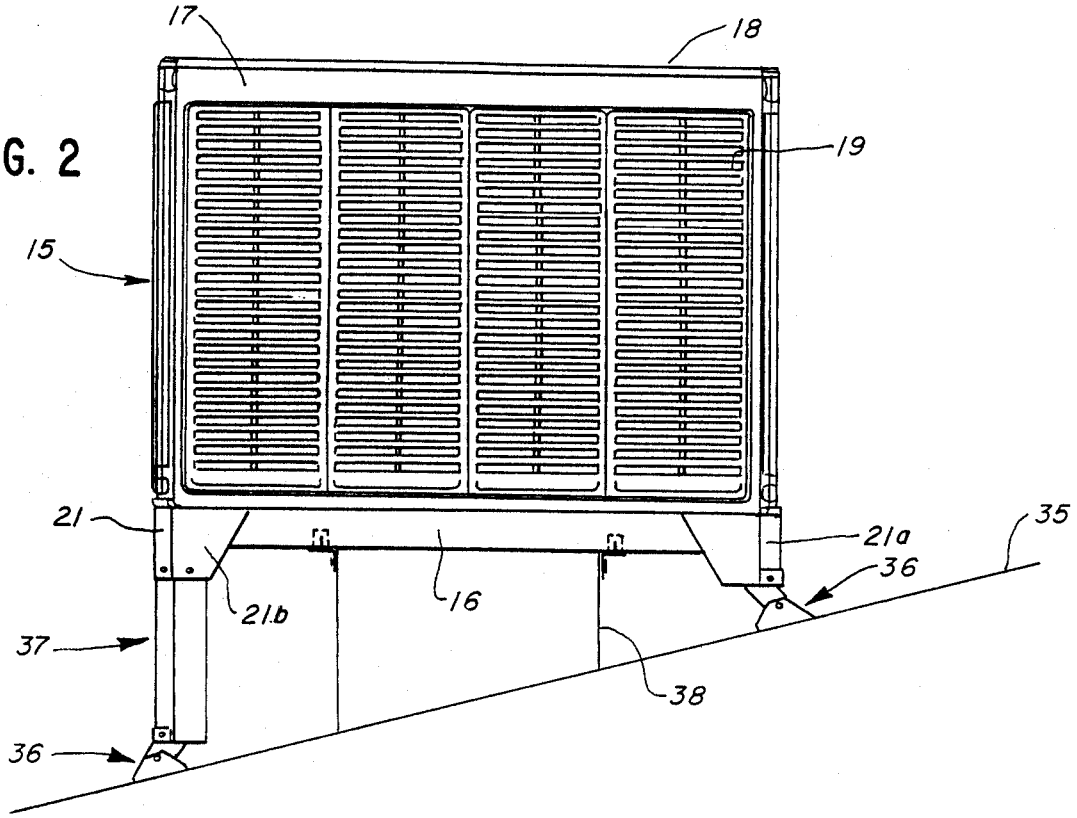
FIG. 2 is a side elevational view showing the cooler mounted on a sloping roof.

Evaporative coolers are commonly mounted on the roof of a building. If the roof slopes, the molded legs 21 permit adjustable leg extensions to be attached to a pair of legs for leveling the cooler. Referring to FIG. 2, the cooler 15 is mounted on a sloping roof 35. A supporting foot assembly 36 is attached directly to each of the rear legs 21*a*, and a leg extension assembly 37 is attached to each of the front legs 21*b*. A foot assembly 36 is attached to the bottom of each leg extension 37. A duct 38 extends from the blower inside the cooler through the roof.

Referring to FIGS. 3 and 4, each leg extension assembly 37 includes an upper leg extension 39 and a lower leg extension 40, each of which can be formed from metal if desired. The upper leg extension 37 has a cross sectional shape corresponding to the shape of the molded leg 21 and includes a central panel 41 and a pair of side panels 42 and 43. Bolt holes 44 in the upper portion of the upper leg extension 39 and bolt holes 45 and a slot 46 in the leg 21 permit those parts to be attached by bolts 47. The bolt holes 44 and 45 are located so that the top of the leg extension 39 abuts the bottom surface 23 of the base 16 (FIG. 7) when the leg extension is attached. The distance between the detents 28–30 and the leg 21 is substantially the same as the thickness of the leg extension 39, and the leg extension 39 is inserted between the detents and the leg 21. The detents thereby retain the leg extension against the leg.

The lower leg extension 40 also includes a central panel 49 and side panels 50 and 51. Each panel is provided with a plurality of vertically spaced bolt holes 52 through 59 for attaching the lower leg extension to the upper leg extension depending upon the pitch of the roof. If desired the bolt holes 52–59 can be kept closed by knock-out slugs so that the desired openings are made by knocking out the appropriate slugs. For example, the holes 53 might be used for a roof with a pitch of 4/12 (4" of drop for every 12" of horizontal distance), the holes 56 might be used for a pitch of 3/12, and the holes 59 might be used for a pitch of 2/12. The selected bolt holes are aligned with bolt holes 60 in the upper leg extension 39 and connected by bolts 61.

The supporting foot assembly 36 is attached to the bottom of the lower leg extension 40 by bolts which extend through bolt holes 63 and 64. The foot assembly includes a metal foot 65 and a metal leveler 66. The foot 65 includes an angle portion 67 which is attached to the lower leg extension and a downwardly extending flat mounting bracket 68 which extends in a generally vertical plane when the foot assembly is attached to the vertically extending leg extension. The leveler 66 includes a flat attaching portion 69 which extends in a vertical plane and a flat support portion 70 which extends perpendicuarly to the attaching portion. A bolt 71 extends through a slot 72 in the leveler and a bolt hole 73 in the foot. Before the bolt 71 is tightened, the foot is adjusted so that the flat supporting portion 70 bears agains the roof.

The foot assembly 36 illustrated in FIG. 4 is designed for use on the left front leg of the cooler. The angle 67 is attached to the panels 49 and 50 of the lower leg extension 40, and the attaching portion 68 extends parallel to the left side panel of the cooler. FIG. 3 illustrates the foot assembly for use on the right front leg of the cooler. The angle **67*a* is attached to the panels 49 and 51 of the lower leg extension 40, and the attaching portion 68*a*** extends parallel to the right side panel of the cooler.

Referring again to FIG. 2, the right and left foot assemblies 36 for the rear legs **21*a* are attached directly to the molded legs 21*a*. No leg extensions are required. If the support surface for the cooler is horizontal, then all of the foot assemblies could be attached directly to the molded legs 21**.

The inner support walls 24 (FIGS. 6 and 7) of the molded legs are provided with channels 75. These channels could be used to receive a molded plastic leg extension if it were desired to use plastic rather than metal leg extensions.

Figure 9:
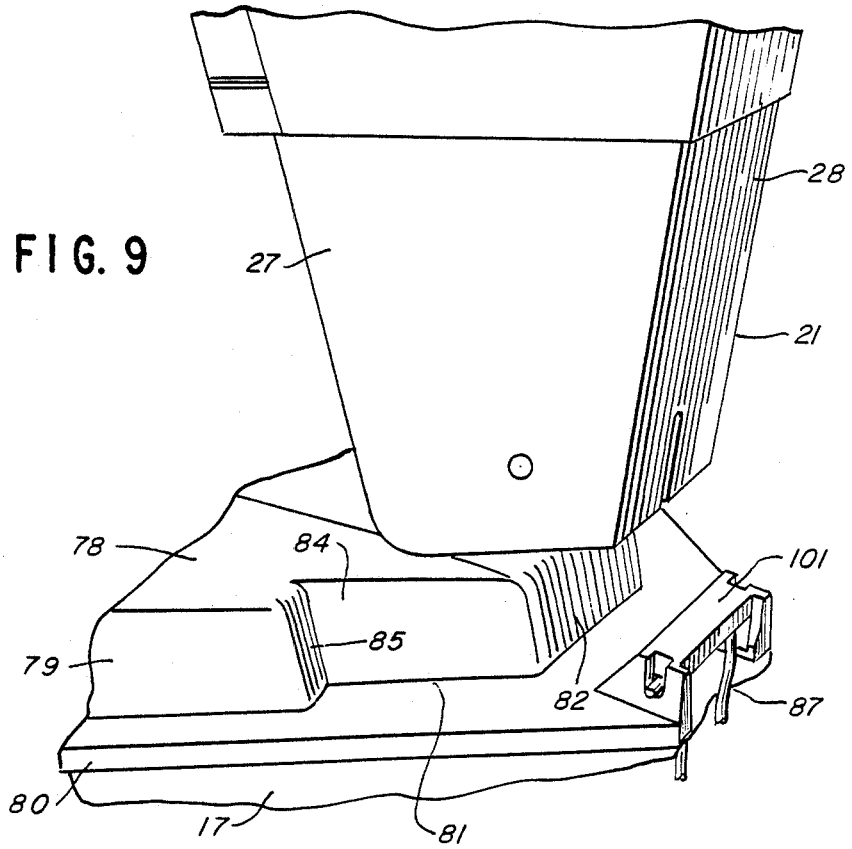
FIG. 9 is a top fragmentary perspective view showing one cooler about to be stacked on top of another cooler.
Figure 10:
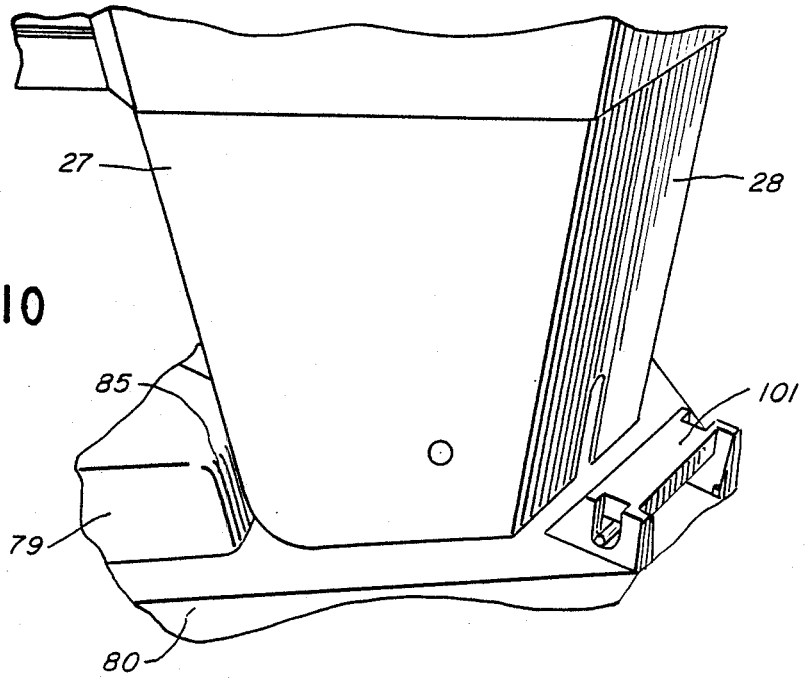
FIG. 10 is a view similar to FIG. 9 showing the stacked coolers.

Referring now to FIGS. 8–10, the top cap 18 includes a generally horizontal central portion 78, a downwardly extending peripheral wall 79, and an outwardly extending horizontal peripheral flange 80. The central portion is slightly raised in the center to facilitate water run-off.

The peripheral wall 79 at each of the corners has a recess 81 which corresponds to the shape of the legs 21 of the base and which is vertically aligned with one of the legs. The corner recess in the wall 79 is formed by a central portion 82, a pair of side portions 83 and 84, and shoulder portions 85 which merge with the straight side portions of the wall 79. The lengths and angles of the wall portions 82–84 correspond with the lengths and angles of the walls 25–27, respectively, of the legs 21. This permits two or more coolers to be stacked in a vertical column by inserting the legs 21 of an upper cooler into the recesses 81 of the next lower cooler as illustrated in FIGS. 9 and 10. The distance between the recesses corresponds to the distance between the legs so that horizontal shifting of the coolers is restrained by engagement of the legs with the walls of the recesses.

Upper and lower latches 87 and 88 (FIG. 8) are mounted at the corners of the top cap 18 and the base 16 for holding the side panels 17 against the top cap and base and against each other. The upper latches also secures the top cap to the side panels.

Each of the side panels 17 includes a mitered right edge portion 89 and a mitered left edge portion 90. The right and left mitered portions of adjacent side panels abut along a vertical line 91 as illustrated in FIG. 8

A right latch bracket 92 is molded integrally with the side panel at the top of the right mitered portion 89, and a left latch bracket 93 is molded integrally at the top of the left mitered portion 90. The right and left latch brackets are provided with vertical grooves 94 and 95, respectively, on their outer lateral sides for engaging the latch 87. The inner lateral sides of the right and left brackets are provided with a V-shaped notch 96 and V-shaped groove 97, respectively, which interfit and prevent relative movement of adjacent side panels when they are latched.

The upper latch 87 is generally U-shaped and includes a U-shaped central portion 98 and a pair of laterally outwardly extending end portions 99. Each of the end portions is slidably mounted in a slot 100 in a mounting bracket 101 which is molded integrally with the peripheral flange 80 of the top cap. The flange 80 is recessed inwardly below the mounting bracket 101 so that the latch 87 can extend vertically downwardly in the latched position illustrated in solid outline in FIG. 8.

The upper latch 87 is generally unlatched by pulling the latch out of the grooves 94 and 95. The latch is formed from spring metal, and the sliding relationship between the end portions 99 of the latch and the slots 100 permit the latch to expand as it is pulled out of the grooves. The mounting bracket 101 is provided with a pair of V-shaped detents 102 for holding the latches in a generally horizontal unlatched position illustrated in dotted outline in FIG. 8. The upper latch is thereby prevented from interfering with the removal and replacement of the side panels.

The side panels are provided with similar lower latch brackets 104 and 105 at the bottom of the right and left mitered portions 89 and 90, respectively, of the side panels. The latch brackets include vertical grooves 106 and 107 for the lower latch 88.

The base 17 includes a raised lip 108 for collecting water, and a mounting bracket 109 for the lower bracket is molded integrally with the lip. The U-shaped lower bracket includes end portions 110 which extend through slots 111 in the lower mounting bracket. The lower mounting bracket is not positioned directly below the lower latch brackets 104 and 105 because of the lip 108, and the legs of the bracket 88 are therefore angled at 112 so that the upper portions of the bracket can extend vertically when the latch is in the latched position illustrated in solid outline.

When the side panels are to be removed, for example, for changing the water-absorbant pads inside of the cooler, the upper and lower latches are pulled outwardly. The side panels can then be removed from the space between the top cap and the base. When the panels are replaced, they are latched merely by pivoting the latches inwardly into engagement with the grooves in the latch brackets.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. An evaporative cooler comprising a molded plastic base, a plurality of side panels mountd on the base, and a top cap above the side panels, the base including a plurality of molded legs, a leg extension attached to at least one of the molded legs for mounting the cooler on a sloping surface, and a leveler support bracket attached to the leg extension and having a flat supporting surface, the leveler support bracket being adjustably attached to the leg extension whereby the angle of the flat supporting surface can be adjusted to correspond to the slope of the roof.

2. The cooler of claim 1 including a foot attached to the leg extension and having a generally vertically extending flat mounting bracket, the leveler support bracket being adjustably attached to the flat mounting bracket.

3. The cooler of claim 1 in which the leg extension includes an upper part attached to the molded leg and a lower part attached to the upper part, one of the upper and lower parts having an attaching opening and the other of the upper and lower parts having a plurality of vertically spaced attaching openings which are alignable with the attaching opening in said one part by moving the parts vertically relative to each other whereby the overall length of the leg extension can be varied.

4. The cooler of claim 1 in which the base includes a downwardly extending projection adjacent said one molded leg and space from one molded leg approximately the thickness of the leg extension for holding the leg extension against the leg.

5. The cooler of claim 1 in which said one molded leg includes a middle vertically extending panel and a pair of side vertically extending panels each of which form an obtuse included angle with the middle panel, said leg extension including a middle vertically extending panel which abuts the middle panel of said one leg and a pair of side vertically extending panels which abut the side panels of said one leg.

6. The cooler of claim 1 in which said top cap is molded plastic and is provided with a recess vertically above said legs, each of said recesses having a shape corresponding to the bottom of the legs whereby a pair of said coolers can be vertically stacked by inserting the legs of the upper cooler into the recesses of the lower cooler.

7. The cooler of claim 6 in which each of said recesses has a plurality of side walls for engaging the leg of a stacked cooler and for restraining horizontal movement of said leg.

8. The cooler of claim 1 including a latch pivotally mounted on the top cap above the juncture between each pair of adjacent side panels and a pair of latch brackets attached to the top of each of the side panels, each of the latches being engageable with a pair of latch brackets on a pair of adjacent side panels for holding the side panels together.

9. The cooler of claim 8 in which each of said latch brackets includes a generally vertically extending groove into which the latch is inserted for latching the brackets.

10. The cooler of claim 8 including a bottom latch pivotally mounted on the base below the juncture between each pair of adjacent side panels and a pair of bottom latch brackets attached to the bottom of each of the side panels, each of the bottom latches being engageable with a pair of bottom latch brackets on a pair of adjacent side panels for holding the side panels together.

11. The cooler of claim 10 in which each of said bottom latch brackets includes a generally vertically extending groove into which the bottom latch is inserted for latching the brackets.

12. An evaporative cooler comprising a molded plastic base, a plurality of side panels mounted on the base, and a molded plastic top cap above the side panels, the base being generally rectangular and having a downwardly extending molded leg at each corner thereof, the top cap being generally rectangular and having a downwardly extending recess at each corner thereof, each recess having a shape corresponding to the bottom of the legs whereby a pair of said coolers can be vertically stacked by inserting the legs of the upper cooler into the recesses of the lower cooler.

13. The cooler of claim 12 in which each of said recesses has a plurality of side walls for engaging the leg of a stacked cooler and for restraining horizontal movement of said leg.

14. An evaporative cooler comprising a generally rectangular molded plastic base, four molded plastic side panels mounted on the base, and a generally rectangular molded plastic top cap above the side panels, a latch pivotally mounted on the top cap at each of the corners thereof for movement between latching and unlatching positions, and a pair of molded latch brackets at the top of each of the side panels, each of the latches being engageable with a pair of latch brackets on a pair of adjacent side panels for holding the side panels together.

15. The cooler of claim 14 in which the latch is generally U-shaped and each of the latch brackets includes a generally vertically extending groove into which the latch is inserted for latching the brackets.

16. The cooler of claim 14 including a bottom latch pivotally mounted on the base below the juncture between each pair of adjacent side panels and a pair of bottom latch brackets attached to the bottom of each of the side panels, each of the bottom latches being engageable with a pair of bottom latch brackets on a pair of adjacent side panels for holding the side panels.

17. The cooler of claim 16 in which each of said bottom latch brackets includes a generally vertically extending groove into which the bottom latch is inserted for latching the brackets.

18. The cooler of claim 14 in which the top cap includes a molded latch support bracket at each corner thereof, each latch having a generally U-shaped latching portion and a pair of outwardly extending end portions which are pivotally mounted in openings in one of the latch support brackets, each of the latch support brackets having a detent for engaging the U-shaped latching portion of a latch for maintaining the latch out of engagement with the side panels when the latch is unlatched.

* * * * *